US005719464A

United States Patent [19]

Honda

[11] Patent Number: 5,719,464

[45] Date of Patent: Feb. 17, 1998

[54] CATHODE RAY TUBE DISPLAY WITH LITTLE TRAPEZOID DISTORTION

[75] Inventor: Masanobu Honda, Osaka, Japan

[73] Assignee: Matsushita Electronics Corporation, Osaka, Japan

[21] Appl. No.: 695,104

[22] Filed: Aug. 7, 1996

[51] Int. Cl.[6] ..... H01J 29/70

[52] U.S. Cl. ..... 313/440

[58] Field of Search ..... 313/440, 430; 335/210, 211, 213

[56] References Cited

U.S. PATENT DOCUMENTS 5,455,483 10/1995 Azzi et al. ..... 313/440

OTHER PUBLICATIONS 4.1.2 Distortion Correction and Focus Control, "Display Monitor for Personal Computer", Mitsubishi Denki Giho, vol. 68, No. 11, 1994.

*Primary Examiner*—Sandra L. O'Shea
*Assistant Examiner*—Vip Patel
*Attorney, Agent, or Firm*—Morrison & Foerster LLP

[57] ABSTRACT

A cathode ray tube display which has improved image quality at the periphery of the screen is achieved by correcting the top-and-bottom or right-and-left trapezoid distortion of a rectangular-shaped raster with a simple and inexpensive method of mounting a magnet in a deflection yoke. A magnet is located in an area extending from a screen side opening end of a ferrite core of a deflection yoke located at the rear periphery of a cathode ray tube to the screen side end of an insulating frame. The magnet is located so that the direction of the magnetic poles substantially conforms to the direction of the tube axis. In addition, the magnet is located so that the center line of the magnet is positioned on a plane which includes the vertical axis and tube axis of the cathode ray tube for the correction of top-and-bottom trapezoid distortion and on a plane which includes the horizontal axis and tube axis of the cathode ray tube for the correction of right-and-left trapezoid distortion.

2 Claims, 6 Drawing Sheets

CATHODE RAY TUBE DISPLAY WITH LITTLE TRAPEZOID DISTORTION

BACKGROUND OF THE INVENTION

This invention relates to improvement of raster distortion in a cathode ray tube display.

In color cathode ray tube displays used as display monitors, it is required to provide clear, fine image display at the periphery of the screen. For example, in a personal computer using Windows (an operating system of Microsoft Corporation), required information is frequently displayed at the periphery of the screen. One of the important factors that determines image quality at the periphery of a screen is raster distortion. Therefore, as demands on the display periphery have increased, so has the call for improvement of raster distortion. Particularly, raster distortion called trapezoid distortion is one of the factors that deteriorates image quality. Therefore, in order to reduce overall raster distortion, one must reduce the trapezoid distortion as well.

An example of a method of correcting the right-and-left trapezoid distortion of a rectangular-shaped raster is proposed in "Display Monitor for Personal Computer", Mitsubishi Denki Giho, Vol. 68, No. 11, 1994, p48–52. In this method, an analog or digital correction waveform is generated in a monitor circuit side and superimposed on a deflecting current.

However, a complex and expensive circuit is required when the correction is performed in the monitor circuit side. This circuit amplitude-modulates a horizontal deflecting current at a vertical deflection period. Such a method only corrects the right-and-left trapezoid distortion of a rectangular-shaped raster, it does not correct top-and-bottom trapezoid distortion.

SUMMARY OF THE INVENTION

The present invention provides a cathode ray tube display with improved image quality at the periphery of the screen. Correction of the top-and-bottom or right-and-left trapezoid distortion of a rectangular-shaped raster is acheived by a simple and inexpensive method of mounting a magnet in the deflection yoke.

In order to achieve the desired result, the present invention uses a deflection yoke located at the rear periphery of a cathode ray tube, comprising a saddle-shaped horizontal coil, an insulating frame provided outside the saddle-shaped horizontal coil, a saddle-shaped vertical coil and a ferrite core provided outside the insulating frame. A first aspect of the invention involves locating a magnet in an area extending from the screen side opening end of the ferrite core to the screen side end of the insulating frame. The center line of the magnet is positioned on a plane which includes the vertical axis and tube axis of the cathode ray tube, with the direction of magnetic poles substantially in the direction of the tube axis.

As a second aspect, a magnet is located in an area extending from the screen side opening end of the ferrite core to the screen side end of the insulating frame. The center line of the magnet is positioned on a plane which includes the horizontal axis and tube axis of the cathode ray tube, with the direction of magnetic poles substantially in the direction of the tube axis.

FIG. 3 relates to the first aspect and shows the generation of right-lowered trapezoid distortion 1 along the upper edge of a rectangular-shaped raster 7 displayed on the screen of a cathode ray tube and the principle of its correction in three dimensions. As shown in FIG. 3, a magnet 6 is located on the upper side of the cathode ray tube, a center line 5 of the magnet is positioned on a plane 4 which includes a vertical axis 2 and a tube axis 3 of the cathode ray tube. The direction of the magnetic poles is substantially the direction of the tube axis with the N pole positioned toward the electron gun and the S pole positioned toward the screen. As a result, magnetic fields BR and BL are generated on the screen side. The direction of magnetic field BR is, as seen in front of the screen, from the right side of the screen to the center. The direction of magnetic field BL is from the left side of the screen to the center. Since electron beams released from an electron gun primarily have a velocity vector in the direction of the tube axis from the electron gun to the screen, electron beams deflected to the upper right portion of the screen are affected by an upward Lorentz force FR due to magnetic field BR. Electron beams deflected to the upper left portion of the screen are affected by a downward Lorentz force FL due to magnetic field BL. Thus, right-lowered trapezoid distortion 1 at the upper edge of rectangular-shaped raster 7 is corrected. Right-raised trapezoid distortion at the upper edge and trapezoid distortion at the lower edge can be corrected using a similar principle.

FIG. 4 relates to the second aspect and shows the generation of upper-widened trapezoid distortion 8 along the right edge of a rectangular-shaped raster 14 displayed on the screen of a cathode ray tube and the principle of its correction in three dimensions. As shown in FIG. 4, a magnet 13 is located on the right side of the cathode ray tube, a center line 12 of the magnet is positioned on a plane 11 which includes a horizontal axis 9 and a tube axis 10 of the cathode ray tube. The direction of the magnetic poles is substantially the direction of the tube axis with the N pole positioned toward the electron gun and the S pole positioned toward the screen. As a result, magnetic fields BT and BB are generated on the screen side. The direction of magnetic field BT is, as seen in front of the screen, from the upper side of the screen to the center, and the direction of magnetic field BB is from the lower side of the screen to the center. Since electron beams released from an electron gun primarily have a velocity vector in the direction of the tube axis from the electron gun to the screen, electron beams deflected to the upper right portion of the screen are affected by a leftward Lorentz force FT due to magnetic field BT. Electron beams deflected to the lower right portion of the screen are affected by a rightward Lorentz force FB due to magnetic field BB. Thus, upper-widened trapezoid distortion 8 at the right edge of rectangular-shaped raster 14 is corrected as shown in FIG. 4. Lower-widened trapezoid distortion at the right edge and trapezoid distortion at the left edge can be corrected using a similar principle.

DETAILED DESCRIPTION OF THE PREFERRED EMBODIMENTS

The embodiments of the present invention will be described below referring to figures.

Figure 1:
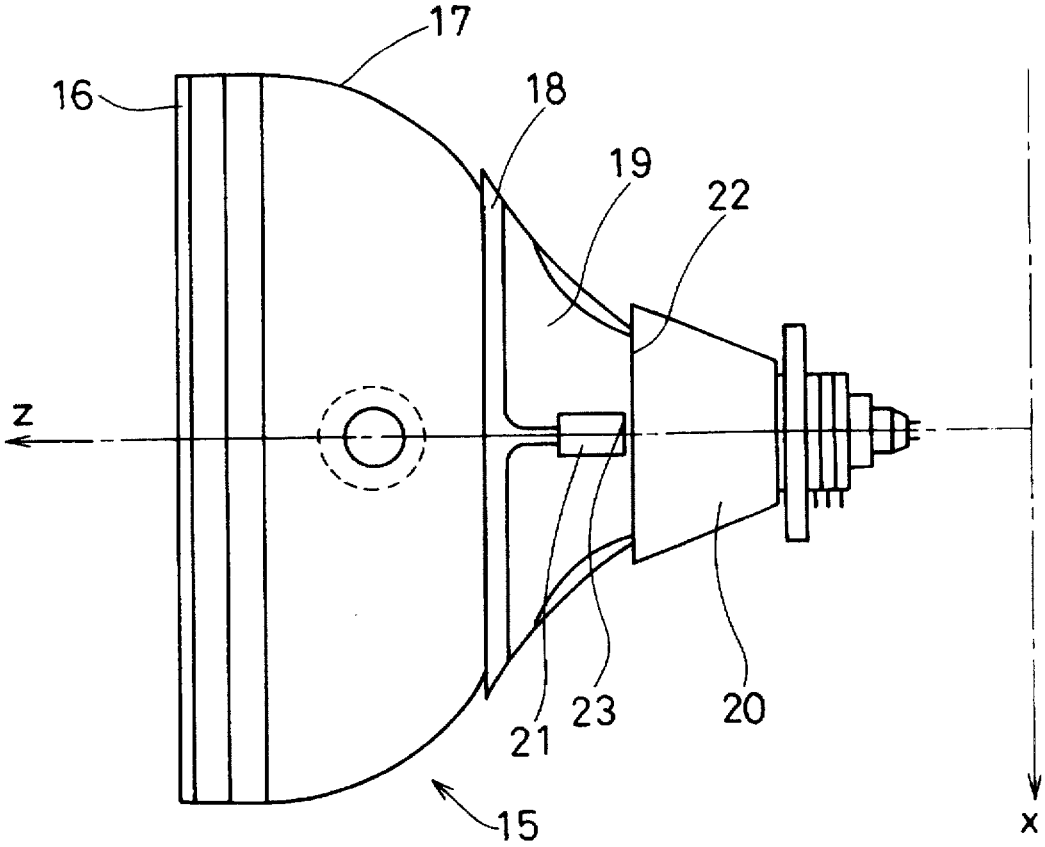
FIG. 1 is a plan view of a cathode ray tube display according to a first embodiment of the present invention.

FIG. 1 is a plan view of a 41 cm (17") and 90° cathode ray tube display according to a first embodiment of the present invention. A cathode ray tube 15 comprises a glass panel 16 and a glass funnel 17 connected to the rear of glass panel 16, and an electron gun (not shown) is provided at the rear of glass funnel 17. Also, a deflection yoke comprising a saddle-shaped horizontal coil (not shown), an insulating frame 18 provided outside the horizontal coil, a saddle-shaped vertical coil 19 provided outside insulating frame 18, and a ferrite core 20 provided outside vertical coil 19 is mounted at the rear periphery of glass funnel 17. A rectangular solid shaped magnet 21 having a sectional size of 2 mm×5 mm and a length of 15 mm which is magnetized in the longitudinal direction is mounted in the deflection yoke. The mounting position of the magnet is on the screen side of a screen side upper part end 22 of ferrite core 20 and in an area on vertical coil 19. The N pole end 23 of magnet 21 is in proximity to the screen side upper part end 22 of ferrite core 20, and the center line of magnet 21 is positioned on a plane which includes the vertical axis and tube axis of the cathode ray tube.

Figure 3:
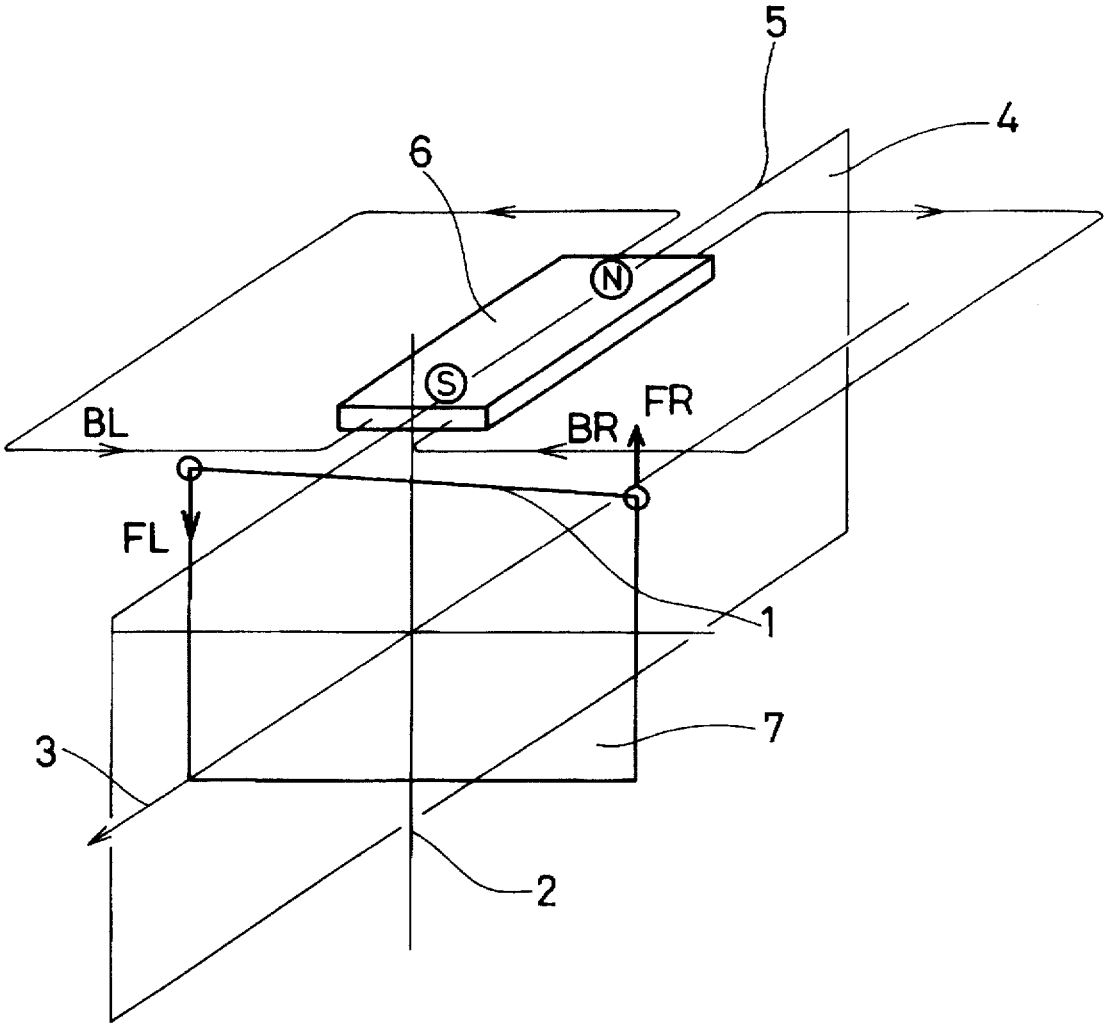
FIG. 3 is a view showing right-lowered trapezoid distortion at the upper edge of a rectangular-shaped raster displayed on the screen of a cathode ray tube and the principle of its correction.

The magnetic field which is generated on the screen side by magnet 21 resembles magnetic fields BR and BL from FIG. 3. Thus, according to the principle mentioned above, right-lowered trapezoid distortion at the upper edge of a rectangular-shaped raster displayed on the screen can be corrected.

Figure 5:
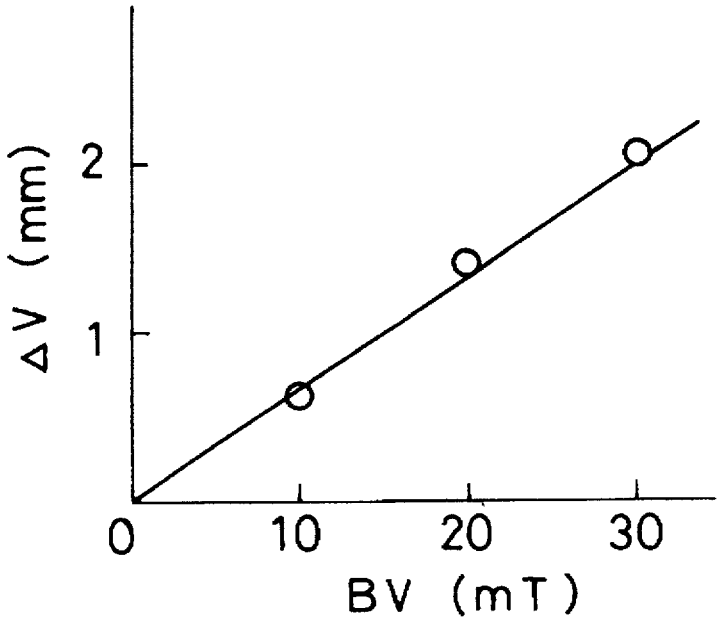
FIG. 5 is a view showing the relationship between magnetic intensity BV of a magnet and correction value ΔV of right-lowered trapezoid distortion at the upper edge of a rectangular-shaped raster.
Figure 7:
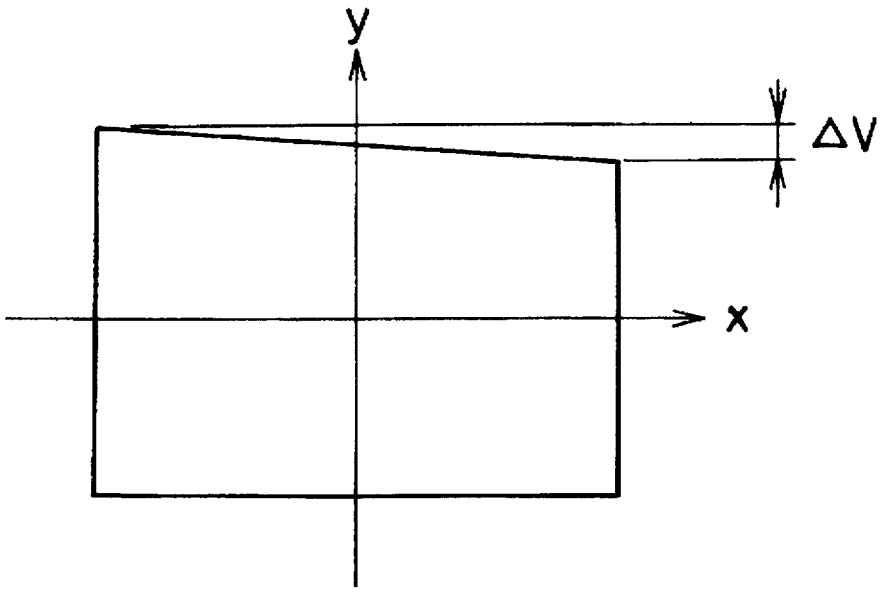
FIG. 7 is a view showing correction value ΔV of right-lowered trapezoid distortion at the upper edge of a rectangular-shaped raster.

FIG. 5 is a graph showing the relationship between the longitudinal direction magnetic intensity BV at the longitudinal direction end of magnet 21 having the above-mentioned dimensions and mounting position and correction value ΔV of right-lowered trapezoid distortion at the upper edge of a rectangular-shaped raster (see FIG. 7). As illustrated, the magnetic intensity BV is approximately proportional to correction value ΔV, and trapezoid distortion of about 2 mm can be corrected with magnetic intensity BV of 30 mT.

Figure 2:
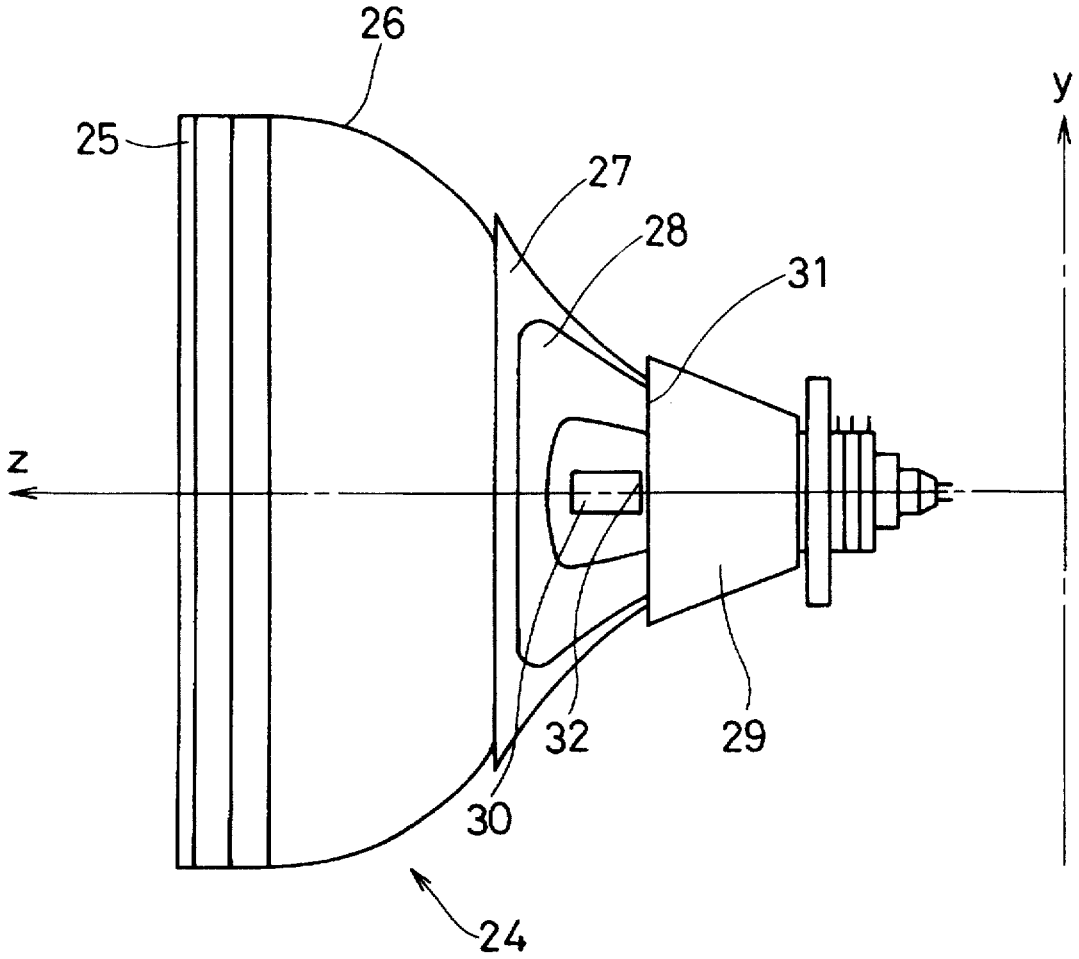
FIG. 2 is a side view of a cathode ray tube display according to a second embodiment of the present invention.

FIG. 2 is a side view of a 41 cm (17") and 90° color cathode ray tube display according to a second embodiment of the present invention. A cathode ray tube 24 comprises a glass panel 25 and a glass funnel 26 connected to the rear of glass panel 25, and an electron gun (not shown) is provided at the rear of glass funnel 26. Also, a deflection yoke comprising a saddle-shaped horizontal coil (not shown), an insulating frame 27 provided outside the horizontal coil, a saddle-shaped vertical coil 28 provided outside insulating frame 27, and a ferrite core 29 provided outside vertical coil 28 is mounted at the rear periphery of glass funnel 26. A rectangular solid shaped magnet 30 having a sectional size of 2 mm×5 mm and a length of 15 mm which is magnetized in the longitudinal direction is mounted in the deflection yoke. The mounting position of the magnet is on the screen side of a screen side right part end 31 of ferrite core 29 and in an area on insulating frame 27. The N pole end 32 of magnet 30 is in proximity to the screen side right part end 31 of ferrite core 29, and the center line of magnet 30 is positioned on a plane which includes the horizontal axis and tube axis of the cathode ray tube.

Figure 4:
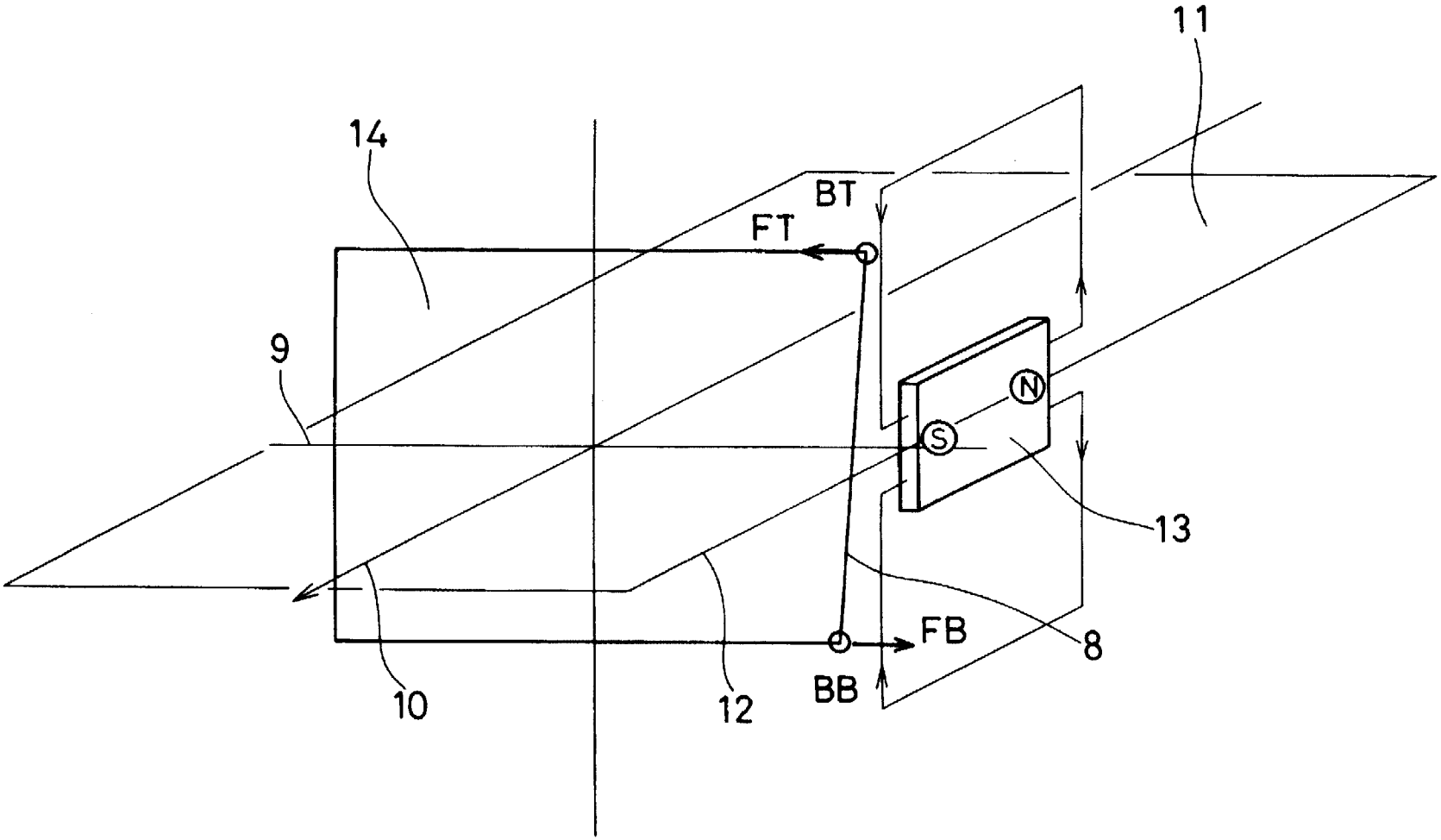
FIG. 4 is a view showing upper-widened trapezoid distortion at the right edge of a rectangular-shaped raster displayed on the screen of a cathode ray tube and the principle of its correction.

The magnetic field which is generated on the screen side by magnet 30 resembles magnetic fields BT and BB from FIG. 4. Thus, according to the above-mentioned principle, upper-widened trapezoid distortion at the right edge of a rectangular-shaped raster displayed on the screen can be corrected.

Figure 6:
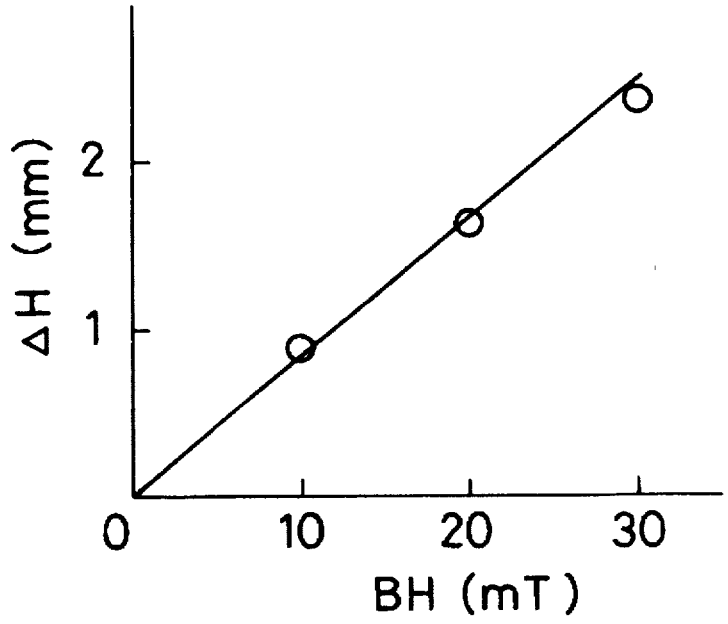
FIG. 6 is a view showing the relationship between magnetic intensity BH of a magnet and correction value ΔH of upper-widened trapezoid distortion at the right edge of a rectangular-shaped raster.
Figure 8:
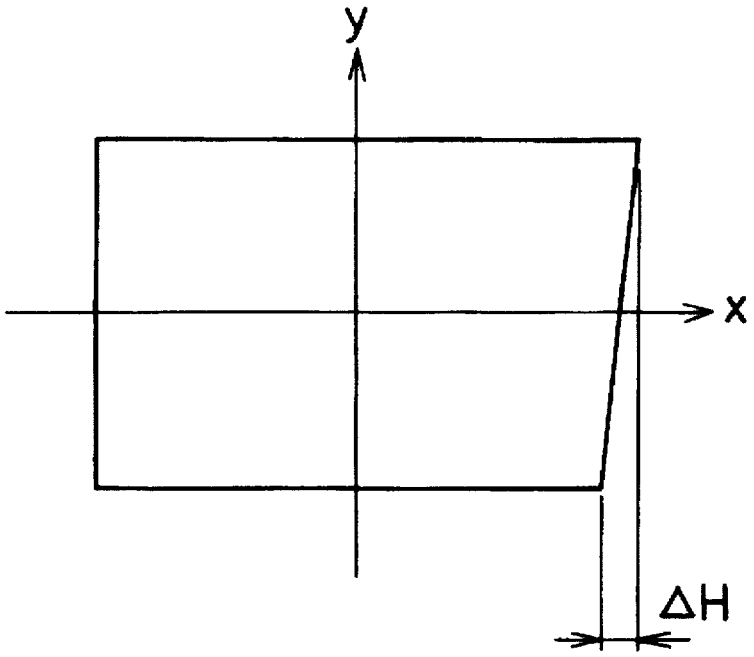
FIG. 8 is a view showing correction value ΔH of upper-widened trapezoid distortion at the right edge of a rectangular-shaped raster.

FIG. 6 is a graph showing the relationship between the longitudinal direction magnetic intensity BH at the longitudinal direction end of magnet 30 having the above-mentioned dimensions and mounting position and correction value ΔH of upper-widened trapezoid distortion at the right edge of a rectangular-shaped raster (see FIG. 8). As illustrated, the magnetic intensity BH is approximately proportional to correction value ΔH, and trapezoid distortion of 2.5 mm can be corrected with magnetic intensity BH of 30 mT.

While the correction of right-lowered trapezoid distortion at the upper edge of a rectangular-shaped raster is described in the first embodiment, correcting right-raised trapezoid distortion requires the direction of the magnet (the polarity of magnetic poles) to be reversed. Also, for correction of trapezoid distortion at the lower edge, the magnet should be similarly located in the lower area of the deflection yoke.

As a method of controlling the correction value of trapezoid distortion, in addition to the method of changing the magnetic intensity of the magnet as mentioned above, there is also a method of changing the mounting position of the magnet in the tube axis direction. Experiments reveal that, in this case, as the magnet is placed closer to the screen side, the correction value of trapezoid distortion decreases. When the magnet passes the screen side end of the insulating frame, the correction value reaches approximately zero.

While the correction of upper-widened trapezoid distortion at the right edge of a rectangular-shaped raster is described in the second embodiment, correcting lower-widened trapezoid distortion requires the direction of the magnet (the polarity of magnetic poles) to be reversed. Furthermore, for correction of trapezoid distortion at the left edge, the magnet should be similarly located in the left side area of the deflection yoke.

As a method of controlling the correction value of trapezoid distortion, in addition to the method of changing the magnetic intensity of the magnet as mentioned above, there is also a method of changing the mounting position of the magnet in the tube axis direction. As the magnet is placed closer to the screen side, the correction value of trapezoid distortion decreases. Experiments reveal that when the magnet passes the screen side end of the insulating frame, the correction value reaches approximately zero.

The reason that the magnet is located on the screen side of the screen side end of the ferrite core is as follows. When the magnet is totally included in an area on the ferrite core, the magnetic field generated by the magnet is induced to the ferrite core, resulting in the loss of trapezoid distortion correction. However, if a part of the magnet projects on the screen side of the screen side end of the ferrite core, the magnet contributes to the correction of trapezoid distortion.

Therefore, by controlling the position of the magnet in the axis direction to control the length of a part of the magnet projecting on the screen side of the screen side end of the ferrite core, the correction value of trapezoid distortion can be controlled.

Also, while the shape of the magnet is rectangular solid in the above-mentioned embodiments, it should not be limited to this shape, and, for example, a columnar shape maybe used. The magnet should be located so that the center line of the magnet is positioned on a plane which includes the vertical axis or horizontal axis of the cathode ray tube and the tube axis. The direction of the magnetic poles is substantially the direction of the tube axis.

Furthermore, a suitable magnet holding structure may be utilized when mounting the magnet to the vertical coil or the insulating frame. In this case, the magnet may be held so that the center axis of the magnet is parallel to the tube axis of the cathode ray tube, with the magnet positioned to a suitable tilt angle.

Even though a deflection yoke with a saddle-shaped vertical coil is described in the above-mentioned embodiments, the vertical coil may be of toroidal shape. When a toroidal-shaped vertical coil is used, it may be wound around the ferrite core.

As mentioned above, according to the present invention, a cathode ray tube display which has improved image quality at the periphery of the screen can be achieved by independently correcting the top-and-bottom or right-and-left trapezoid distortion of a rectangular-shaped raster with a very simple and inexpensive method of mounting a predetermined magnet in a deflection yoke at a predetermined position and direction.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A cathode ray tube display comprising:

a cathode ray tube having a glass panel and a glass funnel connected to the rear of the glass panel;

an electron gun attached to a rear section of the cathode ray tube; and a deflection yoke located in a rear periphery portion of the cathode ray tube, the deflection yoke comprising a saddle-shaped horizontal coil, an insulating frame provided outside the saddle-shaped horizontal coil, a saddle-shaped vertical coil and a ferrite core provided outside the insulating frame, wherein a magnet is located in an area extending from a screen side opening end of the ferrite core to a screen side end of the insulating frame, wherein the center line of the magnet is positioned on a plane which includes the vertical axis and tube axis of the cathode ray tube, and wherein the direction of the magnetic poles is substantially in the direction of the tube axis.

2. A cathode ray tube display comprising:

a cathode ray tube having a glass panel and a glass funnel connected to the rear of the glass panel;

an electron gun attached to a rear section of the cathode ray tube; and a deflection yoke located in a rear periphery portion of the cathode ray tube, the deflection yoke comprising a saddle-shaped horizontal coil, an insulating frame provided outside the saddle-shaped horizontal coil, a saddle-shaped vertical coil and a ferrite core provided outside the insulating frame, wherein a magnet is located in an area extending from the screen side opening end of the ferrite core to the screen side end of the insulating frame, wherein the center line of the magnet is positioned on a plane which includes the horizontal axis and tube axis of the cathode ray tube, and wherein the direction of the magnetic poles is substantially in the direction of the tube axis.

* * * * *